United States Patent [19]

Vigano et al.

[11] Patent Number: 4,857,685

[45] Date of Patent: Aug. 15, 1989

[54] MICROWAVE OVEN WITH IMPROVED HUMIDITY SENSING MEANS

[75] Inventors: Liliana Vigano, Arese; Franciscus Kokkeler, Malnate; Mario Fioroli, Brezzo di Bedero, all of Italy

[73] Assignee: U.S. Philips Corporation, New York, N.Y.

[21] Appl. No.: 311,364

[22] Filed: Feb. 13, 1989

Related U.S. Application Data

[63] Continuation of Ser. No. 154,167, Feb. 8, 1988, abandoned.

[30] Foreign Application Priority Data

Feb. 13, 1987 [IT] Italy ..... 19384 A/87

[51] Int. Cl.[4] ..... H05B 6/68

[52] U.S. Cl. ..... 219/10.55 F; 219/10.55 B; 219/10.55 E

[58] Field of Search ..... 219/10.55 R, 10.55 E, 219/10.55 B, 10.55 F

[56] References Cited

U.S. PATENT DOCUMENTS

| | | | |
|---|---|---|---|
| 4,421,968 | 12/1983 | Osepchuk | 219/10.55 R |
| 4,556,772 | 12/1985 | McCammon et al. | 219/10.55 F |
| 4,587,393 | 5/1986 | Ueda | 219/10.55 B |
| 4,618,756 | 10/1986 | Schwaderer et al. | 219/10.55 R |
| 4,672,180 | 6/1987 | Kusunoki et al. | 219/10.55 R X |

*Primary Examiner*—Philip H. Leung

*Attorney, Agent, or Firm*—Norman N. Spain

[57] ABSTRACT

A microwave oven has a fan for directing air into a cooking chamber, vent holes in the cooking chamber directly communicating with the exterior and having an outlet opening communicating with a compartment in which a humidity sensor for controlling the microwave energy is arranged. The outlet opening is centered substantially relative to the cooking region in which the food is placed. As a result only a defined part of the humid air flow from the food is conveyed to the humidity sensor.

3 Claims, 2 Drawing Sheets

MICROWAVE OVEN WITH IMPROVED HUMIDITY SENSING MEANS

This is a continuation of application Ser. No. 154,167, filed Feb. 8, 1988 now abandoned.

BACKGROUND OF THE INVENTION

The invention relates to a microwave oven comprising a cooking chamber in which food to be heated can be placed, a microwave generator for radiating microwave energy into said chamber to heat said food, fan means for producing an air flow to cool the generator and for directing air into said chamber, and humidity sensor means positioned in a sensor compartment downstream the cooking chamber after leaving said food to sense a change in humidity of the air in said chamber, said cooking chamber having a plurality of inlet apertures and an outlet opening communicating with said sensor compartment.

A known microwave oven of this type is described in U.S. Pat. No. 4,587,393. In this oven, the humidity emitted by the food encounters the humidity sensor together with all the cooling air. The sensed humidity can be used as an indication of the condition of the food. For equal conditions, the quantity of humidity emitted by a food product is related to its free evaporation surface area. The result is that as the cooling air flow is constant, a smaller free evaporation area leads to a greater dilution of the water vapour evolved by the food, the response of the humidity sensor thus occurring when the food has reached a temperature higher than required. Because of this fact, the use of this known method can result in differences of about 30° C. with respect to the required temperature set by the user.

SUMMARY OF THE INVENTION

It is an object of the present invention to alleviate the above described problem by providing a more efficient oven, having a more reliable heating process.

According to the invention a microwave oven of the kind described in the opening paragraph hereof is characterized in that the cooking chamber is provided with a plurality of vent holes directly communicating with the exterior, the outlet opening of the cooking chamber being centered substantially relative to a cooking communicating with the sensor compartment region in which food is placed.

By conveying only a defined part of the humid air flow into the sensor compartment, the sensed humidity results in obtaining a more reliable value in relation to the food temperature for equal quantities of food products having different free evaporation area's. This part of the humid air flow is so defined that the outlet opening to the sensor compartment is centered relative to the position where normally the food is placed.

DETAILED DESCRIPTION OF THE INVENTION

A preferred embodiment of the invention is characterized in that an air distributor is provided at the top of the cooking chamber, the distributor being provided with said plurality of inlet apertures for conveying a part of the air flow into the cooking chamber and with outlet apertures for conveying the remaining part of said air flow into a duct which is arranged underneath said distributor and which opens into the sensor compartment, said outlet opening of the cooking chamber being provided in said duct. The defined part of the humid air flow in the cooking chamber is sucked into the duct through an opening at the lower side of the duct and from there blown into the sensor compartment.

A further embodiment of the invention is characterized in that the air distributor, is provided with a field stirrer, which stirrer comprises impeller blades driven by the air flow before it enters the apertures of said distributor.

The invention will be described in further detail with reference to the accompanying drawing.

Figure 2:
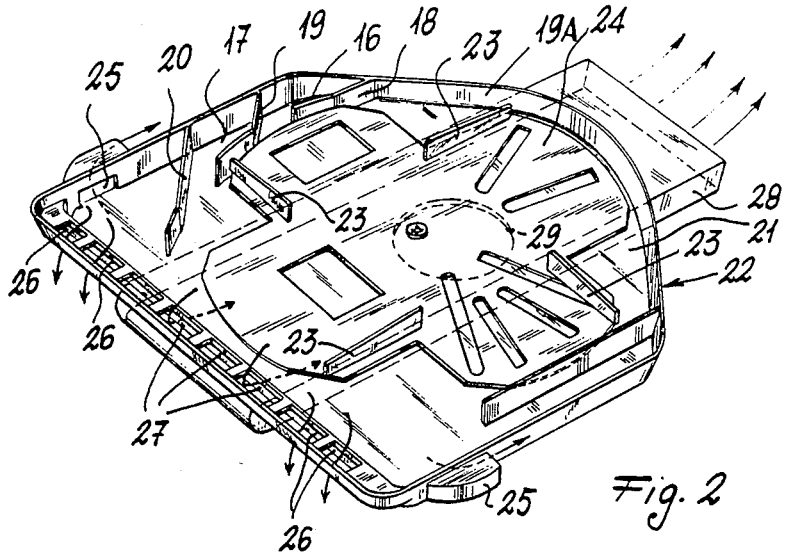
FIG. 2 is a perspective top view of the air flow distributor of the oven shown in FIG. 1
Figure 3:
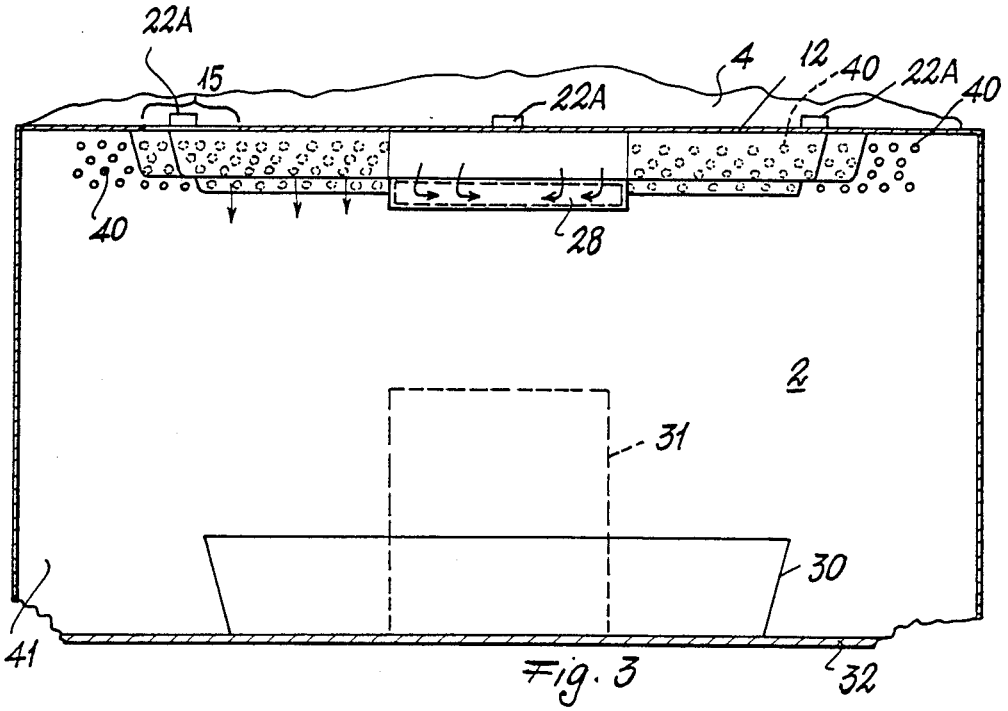
FIG. 3 is a diagrammatic sectional view along the line 111—111 of FIG. 1.

In the Figures, the reference numeral 1 indicates overall a microwave oven comprising a cooking chamber 2, closed at its front by a door 3, and an upper space 4 containing a conventional microwave generator or magnetron 5 and a conventional fan 6 which draws environmental air through an aperture 7 provided for example in a side wall 8 of the oven. In the upper space 4 there is a compartment 9 provided with holes 10 for discharging the cooling air to the external environment and with a conventional humidity sensor 11, the purpose of which is to interrupt heating when the food reaches a given temperature, which can be set by the user. The cooking chamber 2 and the upper space 4 are separated by a horizontal wall 12 centrally raised at 13 where the magnetron is supported, and provided with a central hole for the passage of a lower appendix 14 of the magnetron. The wall 12 is also provided with an aperture 15 (see FIG. 3) through which the cooling air after encountering the magnetron 5 discharges through two ducts 16, 17 (see FIG. 2) bounded by upperly the wall 12 by the side walls 18, 19, 19A and 20, and by the base 21 of a distributor indicated overall by 22 and connected to the wall 12 by the engagement of its hook-shaped appendices 22A in apertures of this latter. These ducts convey the cooling air towards impeller blades 23 of a discoidal field stirrer 24 contained in the distributor 22, which is thus rotated to allow suitable distribution of the microwaves within the cooking chamber 2.

By driving the field stirrer, a part of the cooling air is conveyed directly into the cooking chamber 2 through lateral inlet apertures 25 and front inlet apertures 26 of the distributor 22. The remaining air flow is conveyed through apertures 27 into a duct 28 of substantially rectangular cross-section which is arranged underneath the distributor 22 and which opens into the compartment 9 where the humidity sensor 11 is disposed. A part of the air flow in the cooking chamber is discharged to the exterior through vent holes 40 provided in the rear wall 41 of the oven. The other part is discharged through an outlet opening 29 provided in the lower side of the duct 28. Outlet opening 29 is centred substantially relative to a cooking region in which the food is placed. In other words, the vertical projection of the opening 29 (see lines X in FIG. 1) comprises a cooking region C of an oven plate 32 on which a container 30 or 31 is placed.

Figure 1:
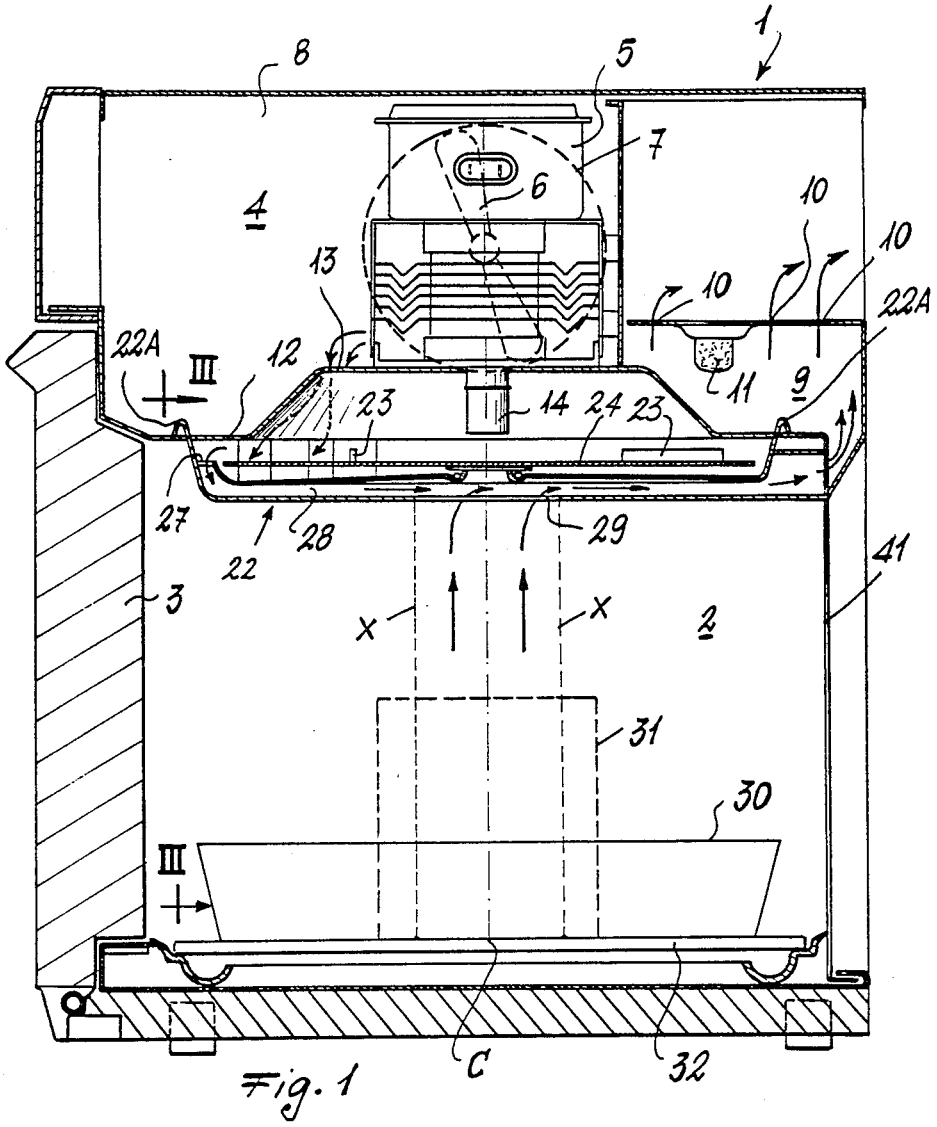
FIG. 1 is a diagrammatic view of a microwave oven of the invention.

The passage cross-section of the opening 29 is chosen at less than the minimum free surface area of the food normally used in the oven and preferably, as shown in FIG. 1, less than the cross-section of the smallest container 31 of those which statistics have proved to be most commonly used in heating. In practice the diameter of opening 29 may be between 4 and 8 cm.

With the invention, only that water vapour originating from a defined region of the food product approximately equal for all food products whatever their evaporation surface area is, passes through the opening 29 of the duct 28 and comes into contact with the humidity sensor 11. Consequently, the humidity which is sensed by the humidity sensor is substantially independent of the effective free surface area of the food and more correctly represents the effective food temperature, to finally allow the humidity sensor to operate as a temperature sensor which terminates the heating process when the required temperature is reached.

A simple numerical comparison clarifies the advantage of the invention. It will be assumed that a precooked foodstuff placed in two different containers such that their free surface areas are in the ratio of 1 to 10 is to be heated to the same temperature in each case. For equal temperatures, the emission of water vapour by the foodstuff will be in the same ratio. In the initially described conventional method, as the quantity of air in which the water vapour becomes distributed is equal in each case, the humidities sensed by the humidity sensor are in the same ratio, so that the sensor is not able to operate as a temperature sensor with properly accurate results. However, with the described invention both for the one and the other of the two said containers a substantially constant quantity of water vapour is conveyed to the air flow passing through the duct 28, with the result that equal humidities are sensed by the humidity sensor, which can then operate correctly as a temperature sensor.

The user sets the required programs, which in the specific example is the heating programs, by operating at least one pushbutton or knob, and the program is executed under the control of a program (microprocessor), and automatically stops, in the case of heating, when the humidity sensor senses the predetermined humidity.

What is claimed is:

1. A microwave oven comprising a cooking chamber (2) in which food to be heated can be placed, a microwave generator (5) for radiating microwave energy into said chamber to heat said food, fan means (6) for producing an air flow to cool said generator and directing said air flow into said cooking chamber (2), and toward said food being heated and then away from said food and away from said cooking chamber (2) and into a sensor compartment (9) provided with humidity sensor means (11) and positioned in the path of a part of said air flow after said air flow passes away from said food, said sensor means (11) being capable of sensing a change in humidity of the air in said cooking chamber (2), said cooking chamber (2) having a plurality of inlet apertures (25, 26) for conveying said air flow into said cooking chamber (2), an oven plate means (32) for supporting said food within said cooking chamber, an outlet opening (29) communicating with said sensor compartment (9) for conveying a portion of said air flow, after passing away from said food, into said sensor compartment (9) and positioned along an axis passing through substantially the center of said oven plate means (32) and substantially perpendicular to said oven plate means (32) and a plurality of vent holes (40) provided in a wall of said oven and directly communicating with the exterior of said oven for discharging the remaining portion of the air flow, after passing away from said food, into said exterior.

2. A microwave oven as claimed in claim 1, characterized in that an air distributor (22) is provided at the top of the cooking chamber (2), said distributor being provided with said plurality of inlet apertures (25,26) for conveying a part of said air flow into the cooking chamber and with outlet apertures (27) for conveying the remaining part of said air flow into a duct (28) which is arranged underneath said distributor (22) and which opens into said sensor compartment (9), said outlet opening (29) of the cooking chamber (2) being provided in said duct (28).

3. A microwave oven as claimed in claim 2, characterized in that a field stirrer (24) is provided with the air distributor (22), said stirrer comprising impeller blades (23) driven by said air flow before it enters the apertures (25,26,27) of said distributor.

* * * * *